US007157017B2

(12) United States Patent
Fenyes et al.

(10) Patent No.: US 7,157,017 B2
(45) Date of Patent: Jan. 2, 2007

(54) FUNGICIDAL COMPOSITIONS AND METHODS USING CYANODITHIOCARBIMATES

(75) Inventors: Joseph G. E. Fenyes, Germantown, TN (US); Thomas E. McNeel, Memphis, TN (US); Stephen D. Bryant, Memphis, TN (US); Marilyn S. Whittemore, Germantown, TN (US); Zoltan G. Csuros, Memphis, TN (US); Mark L. Zollinger, Memphis, TN (US); Robert H. Miller, Eads, TN (US); Naim B. Miguel, Itumbiaria (BR)

(73) Assignee: Buckman Laboratories International, Inc., Memphis, TN (US)

( * ) Notice: Subject to any disclaimer, the term of this patent is extended or adjusted under 35 U.S.C. 154(b) by 406 days.

(21) Appl. No.: 10/721,417

(22) Filed: Nov. 26, 2003

(65) Prior Publication Data

US 2005/0109975 A1 May 26, 2005

(51) Int. Cl.
*C14C 9/00* (2006.01)
*C14C 3/26* (2006.01)

(52) U.S. Cl. ..... 252/8.57; 8/94.1 R; 8/94.19 R; 8/94.2; 8/94.21; 8/94.33; 106/18.33; 514/638

(58) Field of Classification Search ..... 8/94.1 R, 8/94.19 R, 94.2, 94.21, 94.33; 106/18.33; 252/8.57; 514/638
See application file for complete search history.

(56) References Cited

U.S. PATENT DOCUMENTS

| | | | |
|---|---|---|---|
| 2,881,070 | A | 4/1959 | Pera |
| 2,881,071 | A | 4/1959 | Buckman et al. |
| 3,299,129 | A | 1/1967 | D'Amico |
| 3,959,328 | A | 5/1976 | Buckman et al. |
| 4,124,637 | A | 11/1978 | Gutman |
| 4,179,523 | A | 12/1979 | Gutman |
| 4,413,129 | A | 11/1983 | Uchikuga et al. |
| 4,659,708 | A | 4/1987 | Werbel et al. |
| 5,912,004 | A | 6/1999 | Bonjour et al. |
| 6,149,930 | A | 11/2000 | Bonjour et al. |

FOREIGN PATENT DOCUMENTS

| | | | |
|---|---|---|---|
| DE | 256 693 | A1 | 5/1988 |
| DE | 275 391 | A1 | 1/1990 |
| DE | 275 433 | A1 | 1/1990 |
| DE | 275 471 | A1 | 1/1990 |
| DE | 241 204 | A1 | 12/1998 |
| WO | WO 2004/011682 | A | 2/2004 |

OTHER PUBLICATIONS

Fieseler et al., "A New Class of Cyanimidodithiocarbonates With Fungicidal and Bactericidal Activity," *Tagunsber Akad Landwirtsch.-Wiss.*, 291, (1990) 317-321, no month.

Muthusabramanian et al., "Efficient Synthesis of 2-(thiocyanomethylthio)benzothiazole," Thin-Film Micromirror Array, *Journal of Cleaner Production*, 9 (2001) 65-67, no month.

King et al., "Fact and Fantasy Regarding Resistance to Microbicides," *Buckman Laboratories Published Papers*, 96th Annual Meeting of the American Leather Chemists Association, Jun. 2000.

Foeldeny, R., Monatshefte Fur Chemie, vol. 126, 1995, pp. 1035-1044, XP009057151, no month.

Notification Of Transmittal Of The International Search Report And The Written Opinion Of The International Searching Authority, Or The Declaration dated Nov. 24, 2005.

R. Foldenyi, Neue 1H-Tetrazol-5-thiol-Derrivate als Pestizide, 2. Mitt. Cyanimidodithiokohlensauresester, Monatshefte Fur Chemie, 1995, pp. 1035-1044, vol. 126, XP009057151, no month.

Fleischer, 1. Ueber Dithiocyansaure, Just Liebigs Annalender Chemie, V. 179, 1875, pp. 204-224, no month.

Hantzsh, et al., Die Constitution der sogenannten Dithiocyansaure under Persulfocyansaure, Justus Liebigs Annalender Chemie, V. 331, 1904, pp. 265-297, no month.

*Primary Examiner*—Anthony J. Green
(74) *Attorney, Agent, or Firm*—Nixon Peabody LLP; Jeffrey A. Lindeman

(57) ABSTRACT

The invention relates to control fungal growth on tanned hides, using cyanodithiocarbimates of formula (I):

(I)

X is a halogen;

R is a substituted or unsubstituted $C_1$–$C_{14}$ alkyl group, a substituted or unsubstituted $C_2$–$C_{14}$ alkenyl group, a substituted or unsubstituted $C_2$–$C_{14}$ alkynyl group, a substituted or unsubstituted group defined by Y—Ar—$(CH_2)_m$— or by Z—$(CH_2)_n$—;

Ar is a substituted or unsubstituted aryl group selected from phenyl, or naphthyl;

Y is H, halogen, $NO_2$, $R^1$, $R^1O$, $R^1R^2N$;

Z is NC, $R^1O$, $R^1OC(O)$, $R^1OCH_2CH_2(OCH_2CH_2)_p$ m ranges from 0 to 3;

n ranges from 0 to 3;

p ranges from 0 to 3; and $R^1$ and $R^2$ are independently H, substituted or unsubstituted $C_1$–$C_5$ alkyl.

26 Claims, 2 Drawing Sheets

FUNGICIDAL COMPOSITIONS AND METHODS USING CYANODITHIOCARBIMATES

BACKGROUND OF THE INVENTION

1. Field of the Invention

The invention relates to using cyanodithiocarbimates to control fungal growth on animal hides during a hide tanning process. More particularly, the invention relates to the protection of wet blue hides from fungal attack and degradation.

2. Background of the Invention

Leather, as is well known, is produced from animal hides through a multi-stage process which begins with the tanning of hides. Hides are a complex combination of fats and proteins (elastin, collagen, keratin) which provide for the structure and flexibility of the hide. A leather tanning process involves large shifts in temperature, pH, and types of chemistry employed. Leather tanneries are also unique environments for microbial growth. Leather tanneries are relatively open industrial systems which, as part of the tanning process, have a large influx of microorganisms from the process water, the hides or skins, as well as the other process materials. The incoming organisms vary with the incoming materials. Seasonal climate changes also affect the microorganisms in a tannery's process water.

A typical hide tanning process contains several stages to process the hide into an intermediate form, a tanned hide. In a typical chrome tanning process these stages include, for example, washing the hide with water and surfactant to remove debris; soaking the washed hide in an aqueous enzymatic bath (water, enzyme (protease), surfactant and alkali) to rehydrate the hide and remove interfibrillary proteins; dehairing the hide in a "hairburn" step using amines, sodium sulfide; and lime (CaO); deliming the hide by the addition of ammonium sulfate, water and multiple washes to remove alkali used during hair removal and adjust the pH of the hide; bating the hide (addition of a protease) to remove partially hydrolyzed collagen and keratin; pickling the hide (lowering the pH of the hide to prepare for the chrome tanning) by using an acid such as sulfuric acid; tanning by addition of chrome and basification (chrome fixation) by adding magnesium oxide; followed by rinsing. The resulting hide often has a blue color. At this stage the processed, or chrome-tanned, hide is known as a wet blue hide. The wet blue is only an intermediate which is normally stored or shipped to another location for further processing and finishing into leather.

Other methods of tanning, in addition to chrome tanning (which produces "wet blue" hides), which need protection from fungal contamination, include vegetable tanning, "wet white" tanned hides (including aluminum tanning, zirconium tanning, aldehyde tanning, and phosphonium tanning), and oil tanning. Examples of metal free tanning include use of oil, aldehyde or phosphonium salts. The tanned hides resulting from these tanning processes are known as vegetable-tanned hides, wet white hides and oil-tanned hides.

Each stage of a tanning process is a unique chemical environment as well as a unique microbiological environment. The microbial environment in a tanning process impacts the hide being processed. A hide does not typically need to be protected from fungal attack during the tanning process. After the tanning to yield a tanned hide the hide becomes subject to fungal attack and yields visible mold. It is also during the storage/shipping of tanned hides when fungal infestation occurs. A tanned hide is warm, moist, and a source of nutrients which promote fungal growth and mold which disfigures the appearance of the wet blue hide.

Biocides are used to protect tanned hides from fungi. Fungal attack discolors tanned hides, sometimes causing black spots. *Aspergillus niger* is a typical fungus that attacks leather products causing discoloration. This fungal discoloration is difficult to remove and can spoil tanned hides or the finished leather.

To protect the tanned hides (such as wet blue hides, vegetable-tanned hides, wet white hides, and oil-tanned hides), a fungicide is added to a tanning liquor used in the tanning process. Fungicides are often added during one of the late stages of the tanning process. Often a fungicide is added during the pickling stage which occurs under very acidic conditions. The fungicide must survive on the surface of the tanned hide to protect the hide from the time the tanning process is complete until the tanned hide is finished into true leather. To do this, a fungicide should itself survive in the chemical environment of the stage in which it is added as well as in the chemical environment of any subsequent stages. In order to be effective then, the fungicide should be stable under acid conditions, stable to UV-light, relatively unreactive with other tanning process chemicals, and have a high affinity for the hide being tanned. Other segments in the tanning process where fungicides could be employed include: prolonged shelf life of leather finish, fat liquor preservation and during the fatliquoring process.

A need exists in the leather industry for compounds that not only are effective fungicides but also survive the chemical environment of the hide tanning processes. This invention answers that need.

SUMMARY OF THE INVENTION

The invention provides methods for controlling the fungal growth at least one fungas on a tanned hide. This method comprises contacting a hide prior to, during, or after tanning with an effective amount of a cyanodithiocarbimate to control the growth of at least one fungus on the tanned hide. Cyanodithiocarbimates which may be used are those of formula (I):

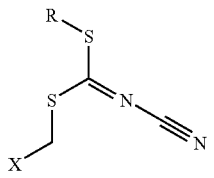

(I)

Cyanodithiocarbimates of formula (I) are useful in preventing the fungal attack, degradation, or deterioration of tanned hides, including but not limited to wet blue hides, wet white hides, vegetable-tanned hides, and oil-tanned hides, from the hide tanning process. New cyanodithiocarbimates of formula (I) represent a further embodiment of the invention.

DETAILED DESCRIPTION OF THE INVENTION

Figure 1:
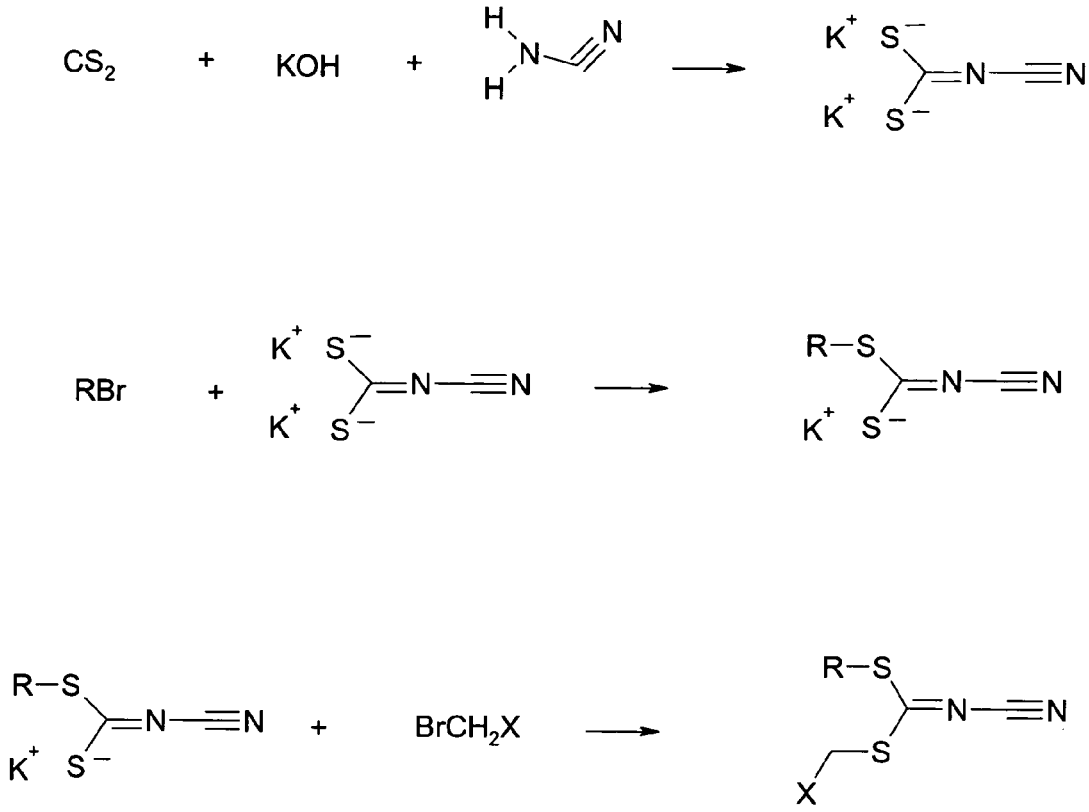
FIG. 1 depicts a general synthetic scheme for cyanodithiocarbimates of formula (I).

As discussed above, the invention relates to the use of cyanodithiocarbimates of formula (I) as fungicides in a tanning process to protect a tanned hide.

(I)

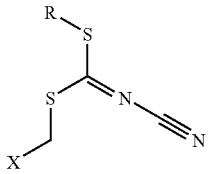

Mixtures of cyanodithiocarbimates of formula (I) may also be used.

In formula (I), X is a halogen, preferably Cl, Br, or I. Most preferably X is Cl.

The substituent R may be, a substituted or unsubstituted $C_1$–$C_{14}$ alkyl group, a substituted or unsubstituted $C_2$–$C_{14}$ alkenyl group, or a substituted or unsubstituted $C_2$–$C_{14}$ alkynyl group. The substituent R may also be a substituted or unsubstituted group defined by Y—Ar—$(CH_2)_m$— or by Z—$(CH_2)_n$—. In the Y—Ar—$(CH_2)_m$— group, m ranges from 0 to 3. Ar is a substituted or unsubstituted aryl group selected from phenyl and naphthyl. Y is H, halogen, $NO_2$, $R^1$, $R^1O$, or $R^1R^2N$. When R is the group defined by Z—$(CH_2)_n$—, Z is NC, $R^1O$, $R^1OC(O)$, or $R_1OCH_2CH_2(OCH_2CH_2)_p$ where p ranges from 0 to 3. The value of n ranges from 0 to 3. $R^1$ and $R^2$ are independently H, substituted or unsubstituted $C_1$–$C_5$ alkyl.

In a preferred embodiment, R is a substituted or unsubstituted $C_1$–$C_7$ alkyl group, a substituted or unsubstituted $C_2$–$C_7$ alkenyl group, a substituted or unsubstituted group defined by Y—Ar—$(CH_2)_m$— or by Z—$(CH_2)_n$—. The value of n ranges from 0 to 3. In the Y—Ar—$(CH_2)_m$— group, m is 0 or 1. Ar is preferably phenyl. Y is H, Cl, Br, I, $NO_2$, $R^1$, $R^1O$, or $R^1R^2N$. When R is the group defined by Z—$(CH_2)_n$—, wherein Z is NC, $R^1O$, $R^1OC(O)$, or $R_1OCH_2CH_2(OCH_2CH_2)_p$ where p ranges from 0 to 3. $R^1$ and $R^2$ are independently H, methyl, or ethyl. Preferred cyanodithiocarbimates are shown below in Table 1.

For cyanodithiocarbimates of formula (I) the alkyl, alkenyl, or alkynyl groups may be branched or unbranched (i.e., a straight chain). An alkenyl or alkynyl group may be unsaturated at more than one position and may contain both carbon-carbon double bonds and carbon-carbon triple bonds. As indicated various groups may be substituted or unsubstituted by one or more groups that do not adversely effect the fungicidal activity of the cyanodithiocarbimate. Unsubstituted means the particular moiety carries hydrogen atoms on its constituent atoms, e.g. $CH_3$ for unsubstituted methyl. Substituted means that the group can carry typical functional groups know in organic chemistry. Such functional groups include, but are not limited to, halides, hydroxyl, thiols, amine groups, carboxylic acid groups, ketones, aldehydes, nitriles, nitro, azo, nitroso, ethers, thioethers, amides, etc.

TABLE 1

| Preferred Cyanodithiocarbimates |
|---|
| X is Cl |
| R is —$CH_3$, —$(CH_2)_2CH_3$, —$(CH_2)_3CH_3$, —$(CH_2)_5CH_3$, —$(CH_2)_7CH_3$, —$(CH_2)_{11}CH_3$, —$CH(CH_3)_2$, —$CH(CH_3)(CH_2)_3CH_3$, —$(CH_2)_2OH$, —$(CH_2)_3OH$, —$(CH_2CH_2O)_2CH_2CH_2OH$, —$(CH_2)_2CO_2H$, —$CH_2CH_2CN$, —$CH_2CH{=}CH_2$, $CH_2C_6H_5$ |
| X is Br |
| R is —$(CH_2)_3CH_3$, —$CH_2C_6H_5$ |
| X is I |
| R is —$(CH_2)_3CH_3$, —$CH_2C_6H_5$. |

The cyanodithiocarbimates used in the methods of the invention may be prepared according to the general scheme shown in FIG. 1. To generate kabonate, cyanamide was reacted with carbon disulfide and KOH in ethanol under a blanket of nitrogen, with vigorous stirring. The temperature after addition was kept below 25° C. Sodium hydroxide could also have been used to generate the sodium salt, nabonate. Hexyl kabonate was produced by the slow addition of an acetone solution of hexyl bromide to a chilled aqueous solution of kabonate, containing a phase transfer catalyst. The mixture was allowed to come to room temperature and stirring was continued for several hours. The mixture was heated for several hours at 50° C. The acetone was removed under vacuum and the aqueous layer was extracted with methylene chloride or chloroform. The aqueous hexyl kabonate was added over a period of several hours to bromochloromethane (BCM) containing phase transfer catalyst. Heating was continued for six hours. After cooling, the aqueous layer was removed and the organic layer was washed with water, then dried over magnesium sulfate. The BCM was removed under vacuum to recover a pale orange liquid, hexyl chloromethyl cyanodithiocarbimate.

Starting materials to prepare other preferred cyanodithiocarbimates according to the general scheme shown in FIG. 1 include, for example, hexyl chloride, ethyl bromide, propyl bromide, isopropyl bromide, butyl bromide, hexyl bromide, 2-hexyl bromide, octyl bromide, dodecyl bromide, allyl bromide, methyl iodide, hexyl iodide, 3-bromo-1-propanol, chloroethanol, chloroethoxyethoxyethanol, bromopropionic acid, benzyl bromide, 4-methyl benzyl bromide, 4-Chlorobenzyl bromide, and bromopropionitrile. Published synthetic methods for cyanodithiocarbimates such as ethyl chloromethyl cyanodithiocarbimate, propyl chloromethyl cyanodithioicarbimate, isopropyl chloromethyl cyanodithiocarbimate, allyl chloromethyl cyanodithiocarbimate, and benzyl chloromethyl cyanodithiocarbimate are reported in C. Fieseler, W. Walek and U. Thust, Tag.-Ber. Akad. Landwirtsch.-Wiss. DDR, Berlin (1990) 291. 317–321; and German Patent DD 275433 CYANOIMIDODITHIOCARBONATES AS WOOD PRESERVATIVES to W. Walek, J. Nauman, H. D. Pfeiffer, U. Thust, K. Trautner, C. Fieseler, M. Heschel, R. Hesse, H. Kirk and D. Mielke.

As discussed, the invention relates to a method for controlling the growth of at least one fungus on a tanned hide. The method comprises the step of contacting a hide prior to, during or after tanning with an effective amount of a cyanodithiocarbimate of formula (I):

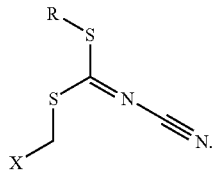

(I)

Controlling the growth of at least one fungus on a tanned hide means control to, at, or below a desired level and for a desired period of time for the particular substrate or system. This can vary from the complete prevention or inhibition of growth to control at a certain desired level and for a desired time. The use of a cyanodithiocarbimate as described here can, in many cases, reduce the total fungal count to undetectable limits and maintain the count at that level for a significant period of time. Preferably, the method may be used to eliminate or prevent substantially all fungal growth on the tanned hide. Accordingly, the invention may be used to preserve a tanned hide.

According to the invention, a cyanodithiocarbimate is used to control fungal growth on a tanned hide after a tanning process. The hide may be any type of hide or skin that is tanned, for example cowhide, snake skin, alligator skin, sheep skin, and the like. The invention is particularly useful in controlling fungal growth on tanned hides during the time after tanning and until processing into finished leather goods. To achieve this control, during the tanning process the hide is contacted with an amount of a cyanodithiocarbimate effective to control the growth of at least one fungus on the tanned hide.

Types of tanning include mineral tanning (use of chromium, aluminum, zirconium, or titanium), vegetable tanning (use of natural extracts such as mimosa, quebracho, tara, or valonia), organic tannages (glutaraldehyde, THPS, or oxazolidine), and oil tanning (for example, use of fish oil to produce chamois). A number of stages comprise a typical tanning process, including, but not limited to, a pickling stage, a tannage addition stage, a basification stage (or fixation stage in the case of vegetable tanning), and a post-tan washing stage. Post-tanning may include a neutralization stage, a retanning stage, a dyeing stage, and a fatliquoring stage. A cyanodithiocarbimate of formula (I) may be used during all process stages in the tanning process in addition to those stages where aknown fungal growth may occur. In each stage, a cyanodithiocarbimate of formula (I) may be a component of the appropriate tanning liquor applied to the hide undergoing tanning. Preferably the hide is contacted with a cyanodithiocarbimate during the pickling stage.

Incorporating a cyanodithiocarbimate into a tanning liquor protects the hide from fungal deterioration subsequent to completion of the tanning process. Preferably, a cyanodithiocarbimate is uniformly dispersed, e.g. under agitation, into an appropriate liquor to be used in a tanning process. Typical tanning liquors include, for example, a mineral tanning liquor, a vegetable tanning liquor, an organic tanning liquor, an oil tanning liquor, a pickling liquor, a post-tan washing liquor, a retanning liquor, a dye liquor, and a fat liquor. This method of application ensures that the cyanodithiocarbimate applied to the hide protects against fungal attack, deterioration, or other microbiological degradation, particularly during storage and transporation of the tanned or pickled hide.

The concentration of the fungicide used to protect the tanned hides depends upon the process conditions used in the tanning process. According to the invention, a cyanodithiocarbimate of formula (I) may be used in similar amounts and manner similar to that used to apply other fungicides used in the tanning industry. The effective amount of the cyanodithiocarbimate necessary to achieve the desired degree of fungal control may vary somewhat depending on the particular hide to be protected, the conditions for fungal growth, and the degree of protection desired. The amount can be readily determined by one skilled in the art. For a particular application, the amount of choice may be determined by routine testing of various amounts prior to treatment of the entire affected leather substrate. In general, an effective amount used on a substrate ranges from about 0.0001% to about 4% (w/w); preferably about 0.0001% to about 0.2%. With aqueous systems, an effective amount may range from about 5 to about 1000 parts per million of the aqueous system, preferably from, about 10 to about 500 parts per million, and more preferably be about 300 parts per million.

In addition to incorporating a cyanodithiocarbimate in a tanning liquor, fungal control may be accomplished by spraying the hide to be protected with a formulation of a cyanodithiocarbimate of formula (I). Fungal control may also be achieved by dipping or soaking the hide in a separate bath containing the cyanodithiocarbimate. Accordingly, the contacting step can also be accomplished by any means known in the art, spraying, soaking, dipping the hide. These can occur prior to tanning, between stages of the tanning process or after the tanning process is complete.

In the methods of the invention, the cyanodithiocarbimates of formula (I) may be formulated in various forms known in the art. For example, they may be prepared in liquid form as an aqueous solution, dispersion, emulsion, or suspension, a dispersion or suspension in a non-aqueous solvent, or as a solution by dissolving the compound(s) to be used in a solvent or combination of solvents. Suitable solvents include, but are not limited to, methyl ethers of glycols, M-pyrol, or petroleum distillates. Diluents such as vegetable products including oils from: soybeans, pine trees, cottonseed, corn, canola, peanut, palm, rice, olive, tung nut, castor bean, linseed, citrus or datenut. The cyanodithiocarbimates may be prepared as a concentrate for dilution prior to its intended use. Common additives such as surfactants, emulsifiers, dispersants, and the like may be used as known in the art to increase solubility in a liquid composition or system, such as an aqueous composition or system. In many cases, the cyanodithiocarbimate compound(s) used may be solubilized by simple agitation.

Fungicidal compositions containing a cyanodithiocarbimate to be used in the method of the invention may also be formulated in solid form, for example as a powder or tablet, using means known in the art. In a preferred formulation for use, a liquid form of a cyanodithiocarbimate is deposited on a carrier such as diatomaceous earth, zeolites, kaolin, or a water-soluble salt matrix to form a powder or tablet.

In another embodiment, the invention relates to new cyanodithiocarbimates of formula (I):

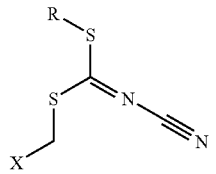

(I)

where:

X is a halogen;

R is a substituted or unsubstituted $C_4$–$C_{14}$ alkyl group, a substituted or unsubstituted $C_2$–$C_{14}$ alkenyl group with the proviso that it is not —$CH_2CH{=}CH_2$, a substituted or unsubstituted $C_2$–$C_{14}$ alkynyl group, a substituted or unsubstituted group defined by Y—Ar—$(CH_2)_m$— or by Z—$(CH_2)_n$—;

Ar is a substituted or unsubstituted aryl group selected from phenyl, and naphthyl;

Y is H, halogen, $NO_2$, $R^1$, $R^1O$, $R^1R^2N$;

Z is NC, $R^1O$, $R^1OC(O)$, $R^1OCH_2CH_2(OCH_2CH_2)_p$ m is 0, 2, or 3;

n ranges from 0 to 3;

p ranges from 0 to 3; and $R^1$ and $R^2$ are independently H, substituted or unsubstituted $C_1$–$C_5$ alkyl.

Preferred cyanodithiocarbimates of formula (I) are those where:

R is a substituted or unsubstituted $C_5$–$C_7$ alkyl group, a substituted or unsubstituted $C_2$–$C_7$ alkenyl group with the proviso that it is not —$CH_2CH{=}CH_2$, a substituted or unsubstituted group defined by Y—Ar—$(CH_2)_m$— or by Z—$(CH_2)_n$—;

Ar is phenyl;

Y is H, Cl, Br, I, $NO_2$, $R^1$, $R^1O$, or $R^1R^2N$;

Z is NC, $R^1O$, $R^1OC(O)$, or $R^1OCH_2CH_2(OCH_2CH_2)_p$ m is 0; and $R^1$ and $R^2$ are independently H, methyl, or ethyl.

More preferred cyanodithiocarbimates of formula (I) are those where:

X is Cl and R is —$(CH_2)_5CH_3$, —$(CH_2)_7CH_3$, —$(CH_2)_{11}CH_3$ —$CH(CH_3)_2$, —$CH(CH_3)(CH_2)_3CH_3$, —$(CH_2)_2OH$, —$(CH_2)_3OH$, —$(CH_2CH_2O)_2CH_2CH_2OH$, —$(CH_2)_2CO_2H$, —$CH_2CH_2CN$, or —$CH_2C_6H_5$;

X is Br and R is —$(CH_2)_3CH_3$, or —$CH_2C_6H_5$; or

X is I and R is —$(CH_2)_3CH_3$, or $CH_2C_6H_5$.

A particularly preferred cyanodithiocarbimates of formula (I) is hexyl chloromethyl cyanodithiocarbimate.

EXAMPLES

Figure 2:
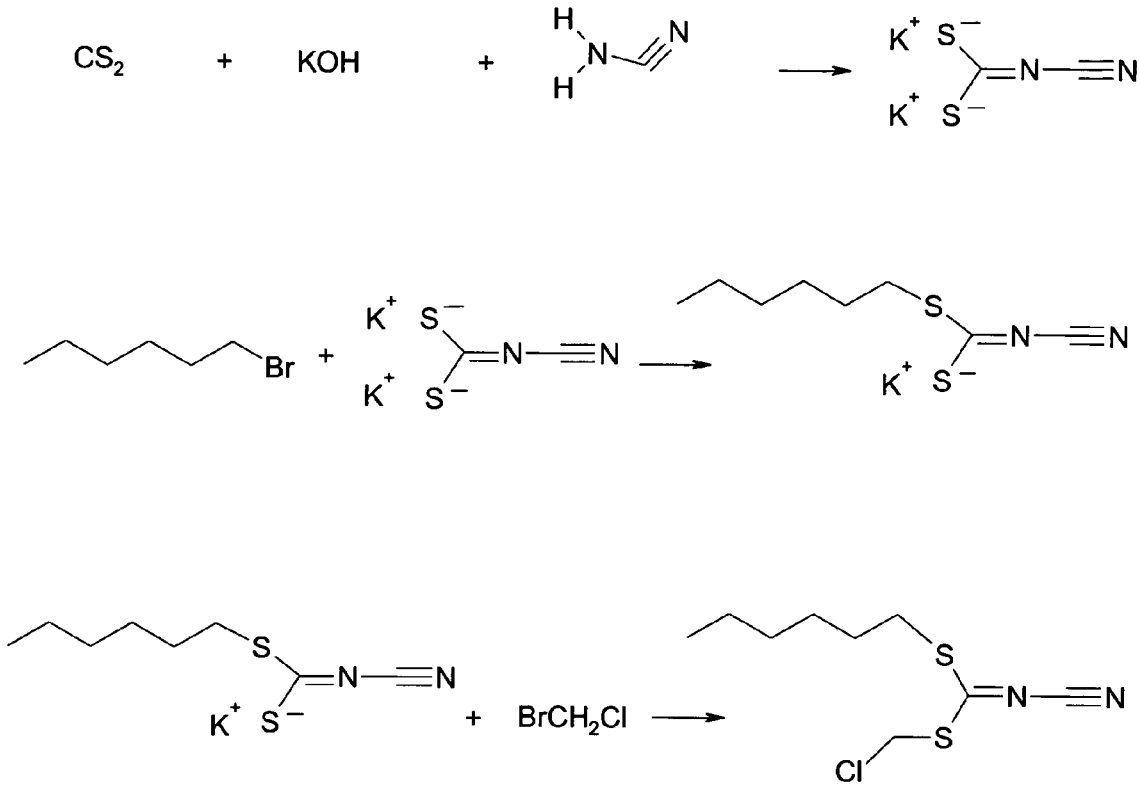
FIG. 2 depicts the synthesis of hexyl chloromethyl cyanodithiocarbimate described in Examples 1–3.

Examples 1–3 describe the synthesis of hexyl chloromethyl cyanodithiocarbimate according to the reaction scheme shown in FIG. 2.

Example 1

Kabonate

Into 2 liters of ethanol was charged 500 grams of solid cyanamide. It was mixed until dissolved and filtered. It was then added to a 12 liter four neck flask, with mechanical stirrer, nitrogen blanket, addition funnel and thermometer and chill to 0° C. with ice/water bath. To the cyanamide solution was added 790 ml carbon disulfide. In 8 liters of ethanol was dissolved 1547 grams of KOH (85%) and addition to the cyanamide/carbon disulfide was begun, keeping temperature below 25° C. After the addition was complete, mixing was continued overnight. The precipitate was collected by filtration and dried with a nitrogen flush.

Example 2

Hexyl Kabonate

Into a 12 liter flask equipped with thermometer, condenser and mechanical stirrer, was added 364 grams of kabonate, 2.8 grams of tetrabutyl ammonium bromide (TBAB) and 2750 grams of water. Solution was mixed for ten minutes before slow addition of 5225 ml of acetone. The mixture was placed in a large ice bath and cooled to 10° C., before the addition of 310 mL bromohexane in acetone, through an addition funnel over a three hour period. The mixture was allowed to come to room temperature and vigorous stirring was continued overnight. The ice bath was removed and heating mantle added. The mixture was heated at 50° C. for one hour. The acetone was removed under vacuum. The aqueous layer was extracted with a small volume of chloroform or methylene chloride.

Example 3

Hexyl Chloromethyl Cyanodithiocarbimate

To a 12 liter flask, 3200 mL of bromochloromethane (BCM) and 6 grams of tetrabutyl ammonium bromide (TBAB) was added. The mixture was heated to 50° C. Aqueous hexyl kabonate was added over three hours through an addition funnel and heating was continued for six hours. After cooling, the solution was transferred to a separatory funnel. The aqueous layer was removed and the BCM layer was washed with water. The BCM layer was dried with magnesium sulfate and solids filtered. The BCM was removed under vacuum to recover pale orange liquid. Product was identified by NMR and IR. Purity was determined by HPLC to be 93%. The yield was greater than 90%.

Example 4

Fungicidal Activity

The antifungal activities of compounds of formula (I) were measured by determining the inhibition of growth of *Aspergillus niger* in a standard liquid medium. The liquid growth medium is described as a solution of mineral salts+yeast extract (MSY). The MSY broth was prepared as described in ASTM G 21–70[1], and amended with glucose (10 g $liter^{-1}$) and yeast extract (1 g $liter^{-1}$). An aliquot (250 μL) of sterile medium was dispensed into each test well of a standard 96-well microplate (Corning No. 430247). Stock solutions of test compounds were prepared by dissolving the materials in 9:1 (v/v) solution of acetone:methanol. Appropriate volumes of stock solutions were added to the test wells in order to achieve the desired ppm levels. Each test well (plus controls) was then inoculated with 5 μL of a standardized suspension of *Aspergillus niger*. The cell suspension was prepared by suspending viable cells from a slant of potato dextrose agar into sterile, deionized water.

The suspension was then adjusted to provide $OD_{686}$=0.28. This density contains approximately $2.5\times10^7$ CFU $mL^{-1}$ (CFU=Colony Forming Units). The microplates were incubated in the dark for four days at 28° C. The optical density for each well at 686 nm was then recorded automatically using a SpectraMax 340 microplate reader (Molecular Devices Corp., Sunnyvale, Calif.). All wells were visually inspected in order to corroborate data from the instrument. Test wells with an OD≦0.05 were judged to exhibit complete inhibition of cellular growth. The results are shown in Table 2.

[1]"Standard Practice for Determining Resistance of Synthetic Polymeric Materials to Fungi",ASTM Standards on Materials and Environmental Microbiology, 1st. Ed., 1987.

TABLE 2

Compounds of Formula (I)

| X | R | Antifungal MIC |
|---|---|---|
| Cl | $—CH_2CHC{=}CH_2$ | 1.0 |
| | $—(CH_2)_7CH_3$ | 2.0 |
| | $—CH_3$ | 1.0 |
| | $—(CH_2)_{11}CH_3$ | 6.0 |
| | $—(CH_2)_5CH_3$ | 0.2 |
| | $—(CH_2)_3CH_3$ | 0.4 |
| | $—(CH_2)_2CH_3$ | 0.5 |
| | $—CH_2C_6H_5$ | 1.0 |
| | $—CH_2(CH_3)_2$ | 0.5 |
| | $—(CH_2)_3OH$ | 6.0 |
| | $—(CH_2CH_2O)_2CH_2CH_2OH$ | 6.0 |
| | $—(CH_2)_2OH$ | 6.0 |
| | $—(CH_2)_2CO_2H$ | >100 |
| Br | $—(CH_2)_3CH_3$ | 1.4 |
| | $—CH_2C_6H_5$ | 2.0 |
| I | $—(CH_2)_3CH_3$ | 2.0 |
| | $—CH_2C_6H_5$ | 5.0 |

Example 5

Performance Testing of the Hexyl Chloromethyl Cyanodithiocarbimate in a Tannery

A methyl carbitol-based formulation containing 30% w/w of hexyl chloromethyl cyanodithiocarbimate was tested in a commercial tannery. Eighty-two cowhides were subjected to a standard production run using chrome tanning. The test formulation was added to the float (tanning liquid) at a concentration of 0.1% by weight providing a concentration of 300 ppm of active ingredient hexyl chloromethyl cyanodithiocarbimate. At the completion of the tanning process, five tanned hides ("wet blues") were chosen randomly. Numerous test pieces (12×14 cm) were cut from the butt, belly, and neck regions of each of the five hides. A total of 47 test pieces of wet blue obtained were coded relative to hide source and position, and each piece was suspended in a tropical chamber. The tropical chamber was a mold-infested humidity chamber designed to severely challenge the test fungicide applied during the tanning process. Each test piece was visually examined on a weekly basis for four weeks for the presence or absence and extent of possible mold growth. After four weeks of incubation in the tropical chamber, each piece tanned in the presence of hexyl chloromethyl cyanodithiocarbimate was free of fungal growth (mold). This is the type of performance desired of a fungicide by the hide tanning industry.

The claimed invention is:

1. A method for controlling the growth of at least one fungus on a tanned hide comprising the step of contacting a hide prior to, during and after tanning with a cyanodithiocarbimate of formula (I):

(I)

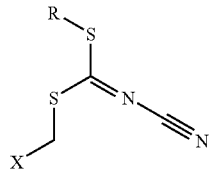

X is a halogen;

R is a substituted or unsubstituted $C_1$–$C_{14}$ alkyl group, a substituted or unsubstituted $C_2$–$C_{14}$ alkenyl group, a substituted or unsubstituted $C_2$–$C_{14}$ alkynyl group, a substituted or unsubstituted group defined by $Y—Ar—(CH_2)_m—$ or by $Z—(CH_2)_n—$;

Ar is a substituted or unsubstituted aryl group selected from phenyl, and naphthyl;

Y is H, halogen, $NO_2$, $R^1$, $R^1O$, or $R^1R^2N$;

Z is NC, $R^1O$, $R^1OC(O)$, or $R^1OCH_2CH_2(OCH_2CH_2)_p$ m ranges from 0 to 3;

n ranges from 0 to 3;

p ranges from 0 to 3; and $R^1$ and $R^2$ are independently H, substituted or unsubstituted $C_1$–$C_5$ alkyl; in an amount effective to control the growth of at least one fungus on the tanned hide.

2. A method of claim 1, wherein:

X is Cl, Br, or I;

R is a substituted or unsubstituted $C_1$–$C_7$ alkyl group, a substituted or unsubstituted $C_2$–$C_7$ alkenyl group, a substituted or unsubstituted group defined by $Y—Ar—(CH_2)_m—$ or by $Z—(CH_2)_n—$;

Ar is phenyl;

Y is H, Cl, Br, I, $NO_2$, $R^1$, $R^1O$, or $R^1R^2N$;

Z is NC, $R^1O$, $R^1OC(O)$, or $R^1OCH_2CH_2(OCH_2CH_2)_p$ m is 0 or 1; and $R^1$ and $R^2$ are independently H, methyl, or ethyl.

3. A method of claim 1, wherein

X is Cl and R is $—CH_3$, $—(CH_2)_2CH_3$, $—(CH_2)_3CH_3$, $—(CH_2)_5CH_3$, $—(CH_2)_7CH_3$, $—(CH_2)_{11}CH_3$, $—CH(CH_3)_2$, $—CH(CH_3)(CH_2)_3CH_3$, $—(CH_2)_2OH$, $—(CH_2)_3OH$, $—(CH_2CH_2O)_2CH_2CH_2OH$, $—(CH_2)_2CO_2H$, $—CH_2CH_2CN$, $—CH_2CH{=}CH_2$, or $—CH_2C_6H_5$;

X is Br and R is $—(CH_2)_3CH_3$, or $—CH_2C_6H_5$; or

X is I and R is $—(CH_2)_3CH_3$, or $—CH_2C_6H_5$.

4. A method of claim 1, wherein the cyanodithiocarbimate of formula (I) is hexyl chloromethyl cyanodithiocarbimate.

5. A method of claim 1, wherein the leather substrate is a wet blue hide a wet white hide, a vegetable-tanned hide or an oil-tanned hide.

6. A method of claim 3, wherein the leather substrate is a wet blue hide a wet white hide, a vegetable-tanned hide or an oil-tanned hide.

7. A method of claim 4, wherein the leather substrate is a wet blue hide a wet white hide, a vegetable-tanned hide or an oil-tanned hide.

8. A method for controlling the growth of microorganisms on a hide during a leather tanning process comprising the step of contacting a hide susceptible to fungal growth with a tanning liquor containing a cyanodithiocarbimate of formula (I):

(I)

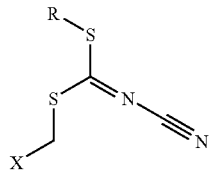

X is a halogen

R is a substituted or unsubstituted $C_{1-C14}$ alkyl group, a substituted or unsubstituted $C_{2-C14}$ alkenyl group, a substituted or unsubstituted $C_{2-C14}$ alkynyl group, a substituted or unsubstituted group defined by Y—Ar—$(CH_2)_m$— or by Z—$(CH_2)_n$—;

Ar is a substituted or unsubstituted aryl group selected from phenyl, and naphthyl;

Y is H, halogen, $NO_2$, $R^1$, $R^1O$, or $R^1R^2N$;

Z is NC, $R^1O$, $R^1OC(O)$, or $R^1OCH_2CH_2(OCH_2CH_2)_p$ m ranges from 0 to 3;

n ranges from 0 to 3;

p ranges from 0 to 3; and $R^1$ and $R^2$ are independently H, substituted or unsubstituted $C_1$_$C_5$ alkyl;

in an amount effective to control the growth of at least one fungus on the hide.

9. A method of claim 8, wherein

R is a substituted or unsubstituted $C_1$_$C_7$ alkyl group, a substituted or unsubstituted $C_2$_$C_7$ alkenyl group, a substituted or unsubstituted group defined by Y—Ar—$(CH_2)_m$— or by Z—$(CH_2)_n$—;

Ar is phenyl;

Y is H, Cl, Br, I, $NO_2$, $R^1$, $R^1O$, or $R^1R^2N$;

Z is NC, $R^1O$, $R^1OC(O)$, or $R^1OCH_2CH_2(OCH_2CH_2)_p$ m is 0 or 1; and $R^1$ and $R^2$ are independently H, methyl, or ethyl.

10. A method of claim 8, wherein

X is Cl and R is —$CH_3$, —$(CH_2)_2CH_3$, —$(CH_2)_3CH_3$, —$(CH_2)_5CH_3$, —$(CH_2)_7CH_3$, —$(CH_2)_{11}CH_3$, —$CH(CH_3)_2$, —$CH(CH_3)(CH_2)_3CH_3$, —$(CH_2)_2OH$, —$(CH_2)_3OH$, —$(CH_2CH_2O)_2CH_2CH_2OH$, —$(CH_2)_2CO_2H$, —$CH_2CH_2CN$, —$CH_2CH{=}CH_2$, or —$CH_2C_6H_5$;

X is Br and R is —$(CH_2)_3CH_3$, or —$CH_2C_6H_5$; or

X is I and R is —$(CH_2)_3CH_3$, or —$CH_2C_6H_5$.

11. A method of claim 8, wherein the cyanodithiocarbimate of formula (I) is hexyl chloromethyl cyanodithiocarbimate.

12. A method of claim 8, wherein the hide is a wet blue hide, a wet white hide, a vegetable-tanned hide or an oil-tanned hide.

13. A method of claim 10, wherein the hide is a wet blue hide, a wet white hide, a vegetable-tanned hide or an oil-tanned hide.

14. A method of claim 11, wherein the hide is a wet blue hide, a wet white hide, a vegetable-tanned hide or an oil-tanned hide.

15. A method of claim 8, wherein the tanning liquor is a pickling liquor.

16. A method of claim 8, wherein the cyanodithiocarbimate of formula (I) is present in the tanning liquor in an amount ranging from about 5 to about 500 parts per million.

17. A liquor for use in a leather-tanning process comprising a cyanodithiocarbimate of formula (I):

(I)

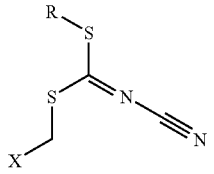

X is a halogen;

R is a substituted or unsubstituted $C_1$_$C_{14}$ alkyl group, a substituted or unsubstituted $C_2$_$C_{14}$ alkenyl group, a substituted or unsubstituted $C_2$_$C_{14}$ alkynyl group, a substituted or unsubstituted group defined by Y—Ar—$(CH_2)_m$— or by Z—$(CH_2)_n$—;

Ar is a substituted or unsubstituted aryl group selected from phenyl, and naphthyl;

Y is H, halogen, $NO_2$, $R^1$, $R^1O$, or $R^1R^2N$;

Z is NC, $R^1O$, $R^1OC(O)$, or $R^1OCH_2CH_2(OCH_2CH_2)_p$;

m ranges from 0 to 3;

n ranges from 0 to 3;

p ranges from 0 to 3; and $R^1$ and $R^2$ are independently H, substituted or unsubstituted $C_1$_$C_5$ alkyl.

18. A liquor of claim 17, wherein

R is a substituted or unsubstituted $C_1$_$C_7$ alkyl group, a substituted or unsubstituted $C_2$_$C_7$ alkenyl group, a substituted or unsubstituted group defined by Y—Ar—$(CH_2)_m$— or by Z—$(CH_2)_n$—;

Ar is phenyl;

Y is H, Cl, Br, I, $NO_2$, $R^1$, $R^1O$, or $R^1R^2N$;

Z is NC, $R^1O$, $R^1OC(O)$, or $R^1OCH_2CH_2(OCH_2CH_2)_p$ m is 0 or 1; and $R^1$ and $R^2$ are independently H, methyl, or ethyl.

19. A liquor of claim 17, wherein

X is Cl and R is —$CH_3$, —$(CH_2)_2CH_3$, —$(CH_2)_3CH_3$, —$(CH_2)_5CH_3$, —$(CH_2)_7CH_3$, —$(CH_2)_{11}CH_3$, —$CH(CH_3)_2$, —$CH(CH_3)(CH_2)_3CH_3$, —$(CH_2)_2OH$, —$(CH_2)_3OH$, —$(CH_2CH_2O)_2CH_2CH_2OH$, —$(CH_2)_2CO_2H$, —$CH_2CH_2CN$, —$CH_2CH{=}CH_2$, or —$CH_2C_6H_5$;

X is Br and R is —$(CH_2)_3CH_3$, or —$CH_2C_6H_5$; or

X is I and R is —$(CH_2)_3CH_3$, or —$CH_2C_6H_5$.

20. A liquor of claim 17, wherein the cyanodithiocarbimate of formula (I) is hexyl chloromethyl cyanodithiocarbimate.

21. A liquor according to claim 17, wherein the liquor is selected from a pickling liquor, a chrome-tanning liquor, a white-tanning liquor, a vegetable-tanning liquor, an oil-tanning liquor, a post-tan washing liquor, a retanning liquor, a dye liquor, and a fatliquor; and wherein the microorganism is algae, fungi, or bacteria; and the cyanodithiocarbimate of formula (I) is present in the tanning liquor in an amount ranging from about 5 to about 500 parts per million.

22. A liquor according to claim 19, wherein the liquor is selected from a pickling liquor, a chrome-tanning liquor, a white-tanning liquor, a vegetable-tanning liquor, an oil-tanning liquor, a post-tan washing liquor, a retanning liquor, a dye liquor, and a fatliquor; and wherein the microorganism is algae, fungi, or bacteria; and the cyanodithiocarbimate of formula (I) is present in the tanning liquor in an amount ranging from about 5 to about 500 parts per million.

23. A liquor according to claim 20, wherein the liquor is selected from a pickling liquor, a chrome-tanning liquor, a white-tanning liquor, a vegetable-tanning liquor, an oil-tanning liquor, a post-tan washing liquor, a retanning liquor, a dye liquor, and a fatliquor; and wherein the microorganism is algae, fungi, or bacteria; and the cyanodithiocarbimate of formula (I) is present in the tanning liquor in an amount ranging from about 5 to about 500 parts per million.

24. A liquor of claim 21, wherein the liquor is a pickling liquor.

25. A liquor of claim 23, wherein the liquor is a pickling liquor.

26. A liquor of claim 17, further comprising a solvent selected from methyl ethers of glycols, M-pyrol, and petroleum distillates; and a diluent selected from soybean oil, pine tree oil, cottonseed oil, corn oil, canola oil, peanut oil, palm oil, rice oil, olive oil, tung nut oil, castor bean oil, linseed oil, citrus oil, and datenut oil.

* * * * *